United States Patent [19]

Van der Ven

[11] 4,207,490

[45] Jun. 10, 1980

[54] SHADOW MASK HAVING APERTURES DIVIDED INTO SYMMETRICAL HALVES BY ISOLATED CONDUCTORS

[75] Inventor: Robert F. L. M. Van der Ven, Eindhoven, Netherlands

[73] Assignee: U.S. Philips Corporation, New York, N.Y.

[21] Appl. No.: 893,951

[22] Filed: Apr. 6, 1978

[30] Foreign Application Priority Data

Apr. 15, 1977 [NL] Netherlands ..... 7704130

[51] Int. Cl.[2] ..... H01J 29/07

[52] U.S. Cl. ..... 313/403; 313/408

[58] Field of Search ..... 313/408, 403, 470, 402, 313/447; 358/71 (U.S. only)

[56] References Cited

U.S. PATENT DOCUMENTS

| | | | |
|---|---|---|---|
| 2,099,749 | 11/1937 | Orth | 313/447 |
| 3,383,536 | 5/1968 | Moss | 313/447 |
| 3,502,942 | 3/1970 | Khan et al. | 313/408 X |
| 3,586,900 | 6/1971 | Seki et al. | 313/408 X |
| 3,888,673 | 6/1975 | Suzuki et al. | 313/403 X |
| 4,059,781 | 11/1977 | Alphen et al. | 313/403 |

*Primary Examiner*—Robert Segal

*Attorney, Agent, or Firm*—Algy Tamoshunas

[57] ABSTRACT

Disclosed is a color display tube having a color selection electrode comprised of a metal plate having a large number of apertures and a plurality of elongated conductors insulated from the plate which extend across the apertures and divide them into two substantially symmetrical halves. Upon application of a suitable potential difference between the conductors and the plate, electric fields are produced in the apertures which deflect the portions of the beam passing through the respective aperture halves towards each other forming on the display screen a single, overlapping electron spot of a width smaller than that of the aperture.

2 Claims, 7 Drawing Figures

Figure 1:
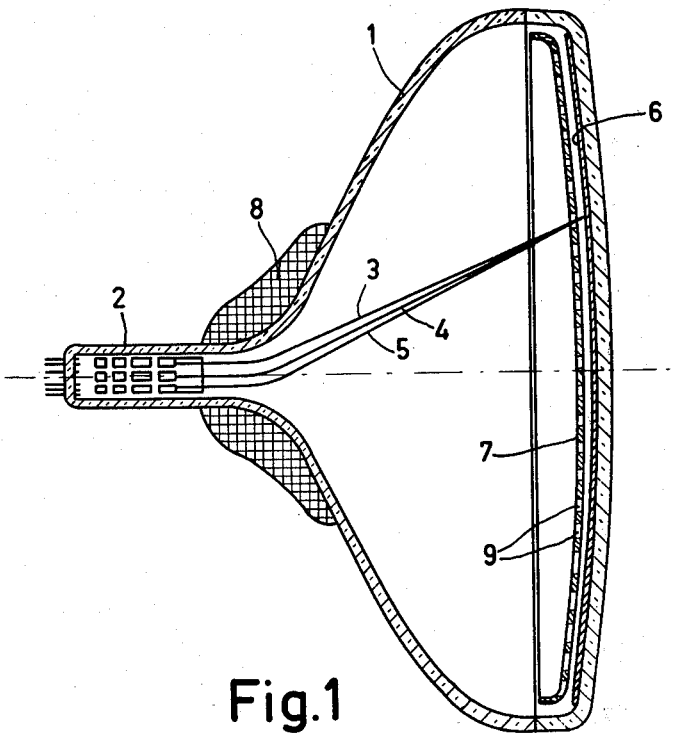

SHADOW MASK HAVING APERTURES DIVIDED INTO SYMMETRICAL HALVES BY ISOLATED CONDUCTORS

The invention relates to a colour picture display tube comprising, in an evacuated envelope, means for generating at least one electron beam, a display screen having a large number of regions luminescing in different colours, and colour selection means comprising a metal plate having a large number of apertures, the plate being provided with elongate conductors which are electrically insulated therefrom.

Such a colour display tube of the post-focusing type is known from Netherlands Patent Application No. 7,409,642 laid open to public inspection corresponding to U.S. Pat. No. 4,059,781.

The object of post-focusing is to increase the brightness of the displayed picture by increasing the transmission of the colour selection means. In tubes without post-focusing, a very large part, for example 80–85%, for the electrons is intercepted by the shadow mask. By using post-focusing, the apertures in the colour selection means can be enlarged since, as a result of the focusing in the apertures, the electron spots on the screen are considerably smaller than the apertures so that there is sufficient landing tolerance even with the increased aperture size. In the arrangement disclosed in the above cited patent application, electrostatic quadrupole lenses are formed in the apertures of the shadow mask which focus the electron beams in one direction. In such a tube, the colour selection means is formed by a grating consisting of two sets of parallel conductors which cross each other and may be interwoven. The conductors of the two sets are insulated from each other at the crossings with the conductors of the respective sets being interconnected. The disadvantage of this construction is that it, may produce moire bands in the displayed picture because the apertures are arranged in horizontal rows.

In another embodiment which is also described in the Netherlands Patent Application No. 7,409,642 laid open to public inspection, the colour selection means is formed by an apertured metal plate which is provided with conductive strips between the rows of apertures, the strips being mutually interconnected and insulated from the metal plate. The moiré effect may be avoided by staggering the apertures in adjacent vertical rows or columns so that they are no longer horizontally aligned. In order to obtain sufficiently strong post-focusing, such an arrangement, however, requires a potential difference between the metal plate and the conductive strips which is considerably larger than the potential difference between the two sets of parallel conductors. However, a large potential difference is undesirable since it gives rise to breakdowns and arcing in the operating tube.

It is therefore an object of the invention to provide a colour display tube having a focusing shadow mask which requires a relatively small potential difference between the plate and the conductors and in which the moiré effects are avoided staggering the mask apertures.

In accordance with the invention, these objects are accomplished by the provision of conductors which extend across and divide the apertures in the shadow mask into two substantially symmetrical halves. The conductors are preferably disposed on the display screen side of the plate. An electrostatic prism or lens is thus formed in each half of the apertures by a dipole field upon application of a potential difference between the conductors and the plate. Depending on the shape of the aperture, a few higher-order electrostatic multipole fields are also produced in the aperture halves which also influence the shape of the spot and can exert a focusing influence on the beam.

Figure 2:
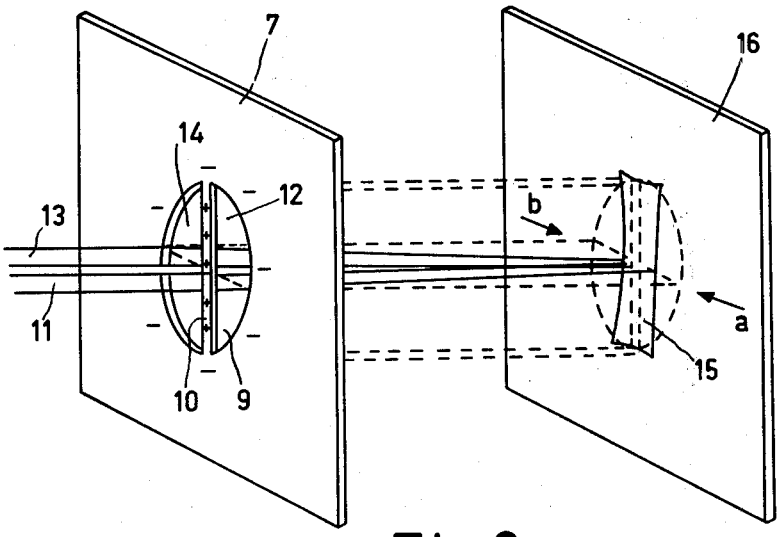
Figure 3:
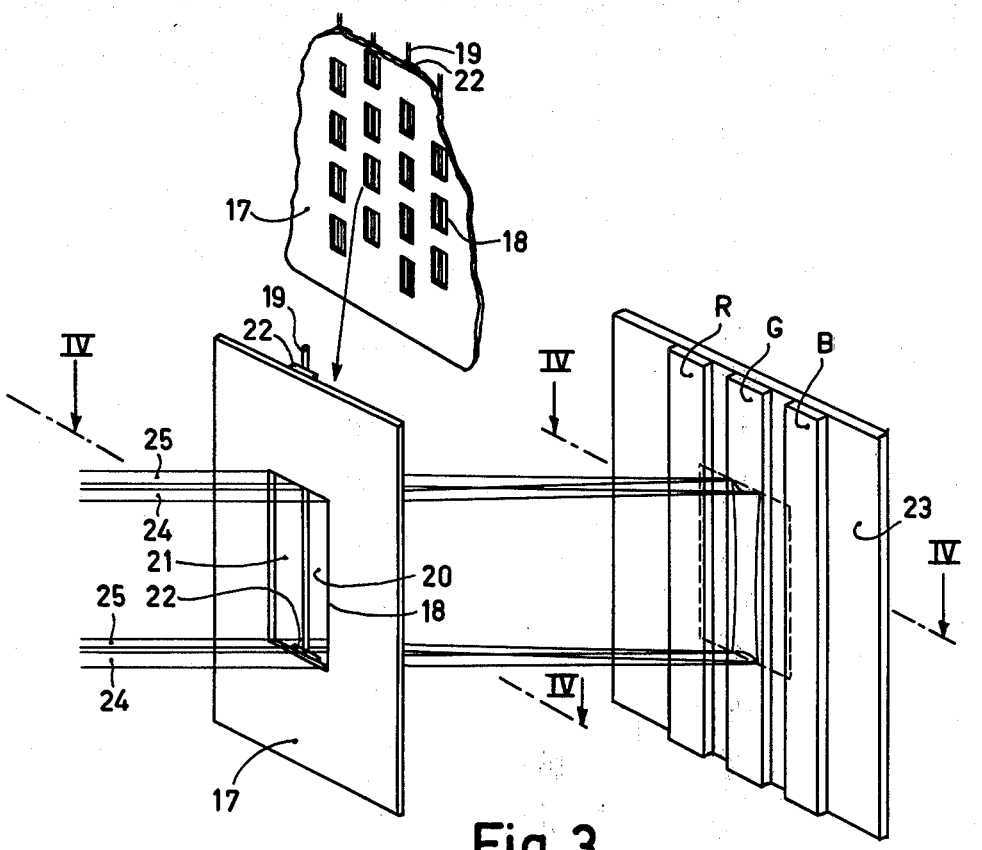
Figure 4:
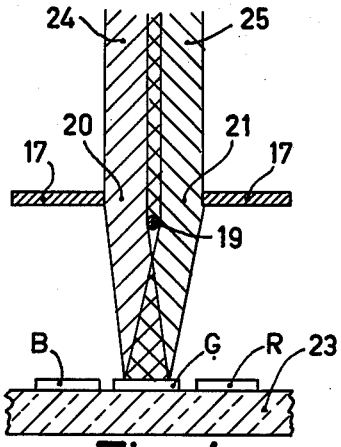
Figure 5:
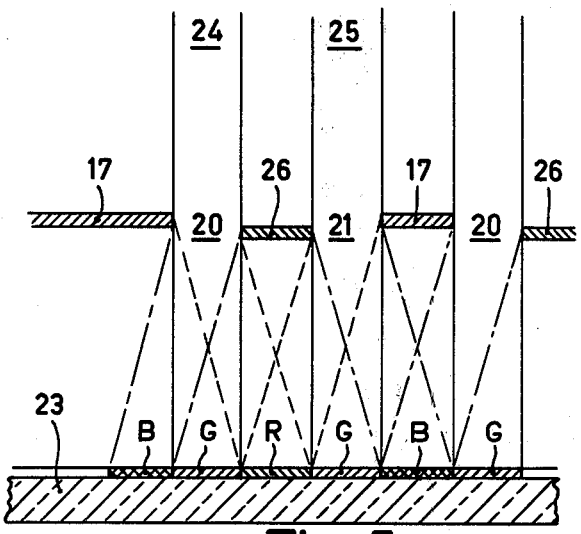
Figure 6:
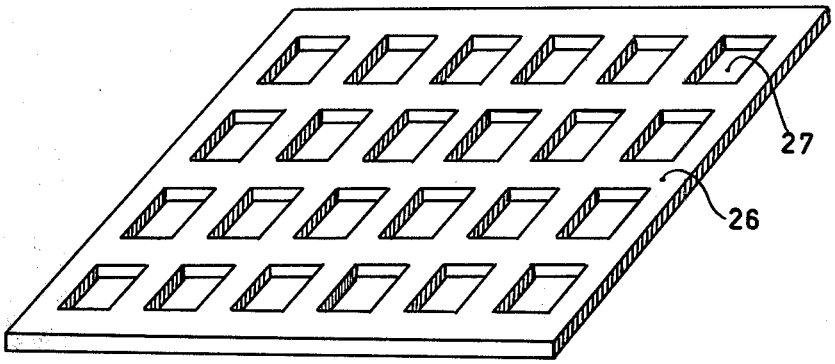
Figure 7:
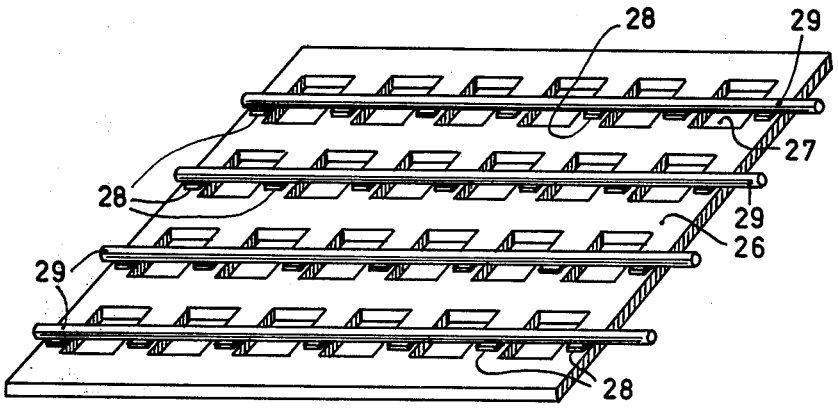

The invention will now be described in greater detail with reference to a drawing, in which FIG. 1 is a diagrammatic sectional view of a display tube for displaying colour pictures according to the invention, FIG. 2 serves to explain the principle of the invention, FIG. 3 shows diagrammatically an embodiment of a tube according to the invention, FIG. 4 is a sectional view of FIG. 3, FIG. 5 shows diagrammatically another embodiment of a tube according to the invention, and FIGS. 6 and 7 show the manufacture of an embodiment of the invention.

The display tube shown in FIG. 1 comprises a glass envelope 1, means 2 for generating three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 by means of the deflection coils 8. The display screen 6 has a larger number of phosphor strips which luminesce in red, green and blue and whose longitudinal direction is at right angles to the plane of the drawing of FIG. 1. During normal operation of the tube, the phosphor strips are vertical and FIG. 1 thus represents a horizontal sectional view of the tube. The colour selection means 7 which will be described in greater detail with reference to FIGS. 3, 4, 6 and 7, has a large number of apertures 9 which are shown diagrammatically in FIG. 1. The three electron beams 3, 4 and 5 pass through the apertures 9 at a small angle to each other and consequently each impinges only upon phosphor strips of one colour. The apertures 9 in the colour selection means 7 are thus positioned very accurately with respect to the phosphor strips of the disply screen 6.

In conventional shadow mask tubes presently in general use the electron beams 3, 4 and 5 are not focused as they pass through the aperture 9. It has been suggested to post-focus the beams by means of a potential difference between the colour selection means 7 and the display screen 6. It has, however, been found that with such an arrangement, the operation of the tube is adversely affected by secondary electrons.

According to the present invention, each aperture in the colour selection means is divided into two substantially symmetrical halves by a conductors. With this construction, an electrostatic multipole lens is formed in each half of the apertures which is mainly a dipole lens and hence predominantly exerts a prism action on the electron beam. Since the dipoles in the two aperture halves are replicas of each other, the prism action in one aperture half is opposite to that in the other aperture half. When the conductors have a positive potential with respect to the plate, the spots on the display screen produced by the electron beam passing through the two halves of an aperture will overlap each other.

FIG. 2 illustrates diagrammatically the dipole action of the lens in the apertures. The figure shows a portion of the colour selection means 7 and one of the apertures 9 which is divided into two halves 12 and 14 by conductor 10. The potential variation along the edges of two halves of aperture is denoted by + and − signs. The portion 11 of the electron beam passing through the half 12 of the aperture is deflected to the left (arrow a) and the part 13 of the electron beam which passes through the half 14 of the aperture is deflected to the right (arrow b). The spots produced by the two portions of the electron beam passing through the respective halves of the aperture, hence, overlap each other and form a single spot 15 on the display screen 16. The shape of the spot can be adapted to the pattern of phosphor strips by a suitable choice of the shape of the aperture. In fact, the shape of the aperture determines the absence or presence of one or more electrostatic multipole fields in the halves of an aperture as well as the strength of the multipole fields. The multipole fields in turn have an influence on the electron beam and, hence, the shape of the spot.

As a result of this focusing action, the aperture 9, as in the known display tubes in which post-focusing takes place by means of quadrupole lenses, may be much larger than in conventional shadow masks without post-focusing. Therefore, a much larger number of electrons impinges upon the display screen 6 and a brighter image is obtained.

FIG. 3 shows another embodiment of a colour display tube according to the invention. In this embodiment the colour selection means includes an iron plate 17 with rectangular apertures 18 which are staggered with respect to each other and a large number of conductive wires 19 which divide the apertures 18 into two substantially symmetrical halves 20 and 21. The conductive wires 19 are insulated from the iron plate 17 by means of insulation material 22. In this case glass was used as an insulating material. The plate 17 is 0.15 mm thick. The glass insulation layer is 0.05 mm thick. The conductive wires 19 in this case consist of tungsten and have a diameter of 0.05 mm. The apertures are 0.56×0.56 mm and their pitch is 0.8 mm so that the electron transmission of the colour selection means is approximately 50%. At a potential of the display screen 23 of 25 kV, a potential of the plate 17 of likewise 25 kV and a potential of the wires 19 of 25.9 kV, good focusing is obtained on the display screen which is positioned at approximately 10 mm from the colour selection electrode.

On the display screen 23, the three phosphor strips associated with the aperture 18 are denoted by R (red), G (green) and B (blue). As described with reference to FIG. 1 there is one electron beam for each colour. FIG. 3 shows only a few rays of the central electron beam which form a spot on the green phosphor strip G. Without the dipole action, the aperture 18 on the display screen 23 would of the size shown by the dotted lines. As a result of the dipole action shown in FIG. 4, the portions 24 and 25 of the electron beam are deflected so that they coincide on the green phosphor strip and form a single spot.

FIG. 5 shows diagrammatically another embodiment of a display tube according to the invention. Instead of wires, 200 μm wide aluminium strips 26 are provided over the 600 μm wide apertures. The bridges between the apertures are also 200 μm wide. It is possible with such colour selection means having a transmission of approximately 45% to use colour selection according to the known chromatron principle. Such tubes require only one electron beam instead of three beams. The colour selection is obtained by making the strips 26 which divide the apertures in plate 17 into two halves 20 and 21, positive, neutral or negative with respect to the plate 17, depending upon the desired colour, so that the beam portions 23 and 25 are moved away from each other and impinge upon the blue phosphor strips B and are not deflected and land on the green phosphor strips G, respectively, and are moved towards each other so that they impinge upon the red phosphor strips R. In such display tubes operating according to the chromatron principle, display screens having adapted phosphor patterns are necessary.

A display screen for a tube according to the invention can be manufactured by means of a known exposure method in which the colour selection means is imaged on a photosensitive layer on a window portion of the tube. Because of the large transmission of the colour selection means according to the invention, the exposure method used should be such that the images of the apertures 9 are much narrower then the apertures themselves and not divided by the "shadow" of the conductors. An exposure method suitable for this purpose uses two or more light sources at some distance from each other, as disclosed in German Patent Application No. 2,248,878. Of course, the tube of the invention can also be made by electronic exposure in which the sensitive layer on the window portion is "exposed" by means of an electron beam.

FIGS. 6 and 7 illustrate a method for assemblying the colour selection means for a colour display tube according to the invention. FIG. 6 shows a 0.15 mm thick iron plate 26 having rectangular apertures 27 which, in contrast with the apertures in FIG. 3, are not staggered with respect to each other. FIG. 7 shows how the 0.05 mm thick tungsten wires 29 are insulated from the plate 26 by means of glass insulation 28, bridge the apertures 27 and divide them into two substantially symmetrical halves. The glass may be provided by means of known glass powder methods. For the manufacture of the colour selection means other techniques may also be used as described in Netherlands Patent Applications Nos. 7,600,420, 7,600,421, 7,600,422, 7,600,418 and 7,600,417, not yet laid open to public inspection.

What is claimed is

1. A colour display tube comprising, in an evacuated envelope, means for generating a plurality of electron beams, a display screen having a plurality of elongated regions luminescing in different colours when struck by said electron beams, said regions being arranged so that the longitudinal axes thereof are substantially parallel to each other, and colour selection means positioned in the path of said beams between said generating means and said screen for directing each of said beams to regions luminescing in a given colour, said colour selection means including an electrically conductive plate having a plurality of apertures for passing said beams therethrough and a plurality of elongated conductors secured to and electrically insulated from said plate, each of said conductors extending across at least one of said apertures in a direction generally parallel to said longitudinal axes and dividing said at least one aperture into two substantially symmetrical halves so that upon application of a potential difference between said plate and said conductors electric fields are produced in each of the apertures which deflect the portions of said beam passing through the respective halves of a given aperture towards each other in a direction generally perpendicular to said longitudinal axis so that a single, overlapping spot of a dimension in a direction perpendicular to said longitudinal axes smaller than the corresponding dimension of said aperture is formed from said portions of said beam on said display screen.

2. The colour display tube according to claim 1 wherein said luminescent regions are in the form of substantially parallel strips and said apertures are elongated in a direction parallel to the longitudinal axes of said strips.

* * * * *